United States Patent [19]

Brockway

[11] 4,113,309

[45] Sep. 12, 1978

[54] HEADREST FOR DENTAL CHAIR

[75] Inventor: Charles E. Brockway, Rochester, N.Y.

[73] Assignee: Sybron Corporation, Rochester, N.Y.

[21] Appl. No.: 861,351

[22] Filed: Dec. 16, 1977

[51] Int. Cl.[2] ..... A47C 1/10

[52] U.S. Cl. ..... 297/408

[58] Field of Search ..... 247/408, 409

[56] References Cited

U.S. PATENT DOCUMENTS

| | | | |
|---|---|---|---|
| 3,307,874 | 3/1967 | Wilson | 297/408 X |
| 3,603,642 | 9/1971 | Laessker | 297/408 |
| 3,936,091 | 3/1976 | Rabinowitz | 297/408 X |
| 4,014,594 | 3/1977 | Hain | 297/408 |

*Primary Examiner*—James C. Mitchell

*Attorney, Agent, or Firm*—Theodore B. Roessel; Roger Aceto

[57] ABSTRACT

Disclosed is an articulated headrest for use with dental chairs and the like which can be quickly and easily converted from left hand to right hand operation. A simple clutch mechanism locks the headrest at any adjusted position. The mechanism for unlocking the clutch is a push button located at the side of the headrest. This mechanism is contained in a housing which can be easily removed and its components rearranged to move the push button from one side of the headrest to the other.

8 Claims, 4 Drawing Figures

HEADREST FOR DENTAL CHAIR

BACKGROUND OF THE INVENTION

The present invention relates to an adjustable headrest for the dental chairs and the like, and more specifically, to a headrest which is convertible to either a right hand or a left hand operation.

Various types of articulating headrest for dental chairs and the like are well known in the art. Such headrests are known to include clutch members for locking the headrest in an adjusted position and some sort of lever arm for moving the clutch members out of a locking engagement. Such a headrest is shown, for example, in U.S. Pat. No. 3,936,091.

In the present invention, a push button operated mechanism is used to disengage the clutch members. The push button is located at the side of the headrest. This allows the operator to use his palm and fingers to support and position the headrest as the thumb on the same hand operates the push button. In order to accommodate operation by either the right handed or left handed dentist, the mechanism in the present invention has the capability of being quickly and easily convertible from right hand to left hand operation. More importantly, the components of the mechanism are identical for both left or right hand operation and are merely rearranged at the factory or in the field depending upon the desired mode of operation. This presents a considerable economy feature in that two different mechanisms, one for each mode of operation, need not be manufactured.

SUMMARY OF THE INVENTION

The present invention may be characterized in one aspect thereof by the provision of a pair of clutch members within the headrest for locking the headrest at an adjusted position; and a lever arm pivoted within the headrest for disengaging the clutch members, one end of the lever arm having two branches. A housing attachable to the headrest in either of two positions carries a push button which in turn is connected to a link.

With the housing in one position, the link is fixed to one branch of the lever arm so that the link and the lever arm together form a simple lever for disengaging the clutch members when the button is pushed. When the housing is fixed to the headrest in a second position, rotated 180° from its first position, the link is pivoted intermediate its ends to the housing and has one end pivoted to the second branch of the lever arm. In this configuration, the link and lever arm together form a compound lever for disengaging the clutch members when the push button is operated from the other side of the headrest.

DESCRIPTION OF THE PREFERRED EMBODIMENTS

Figure 1:
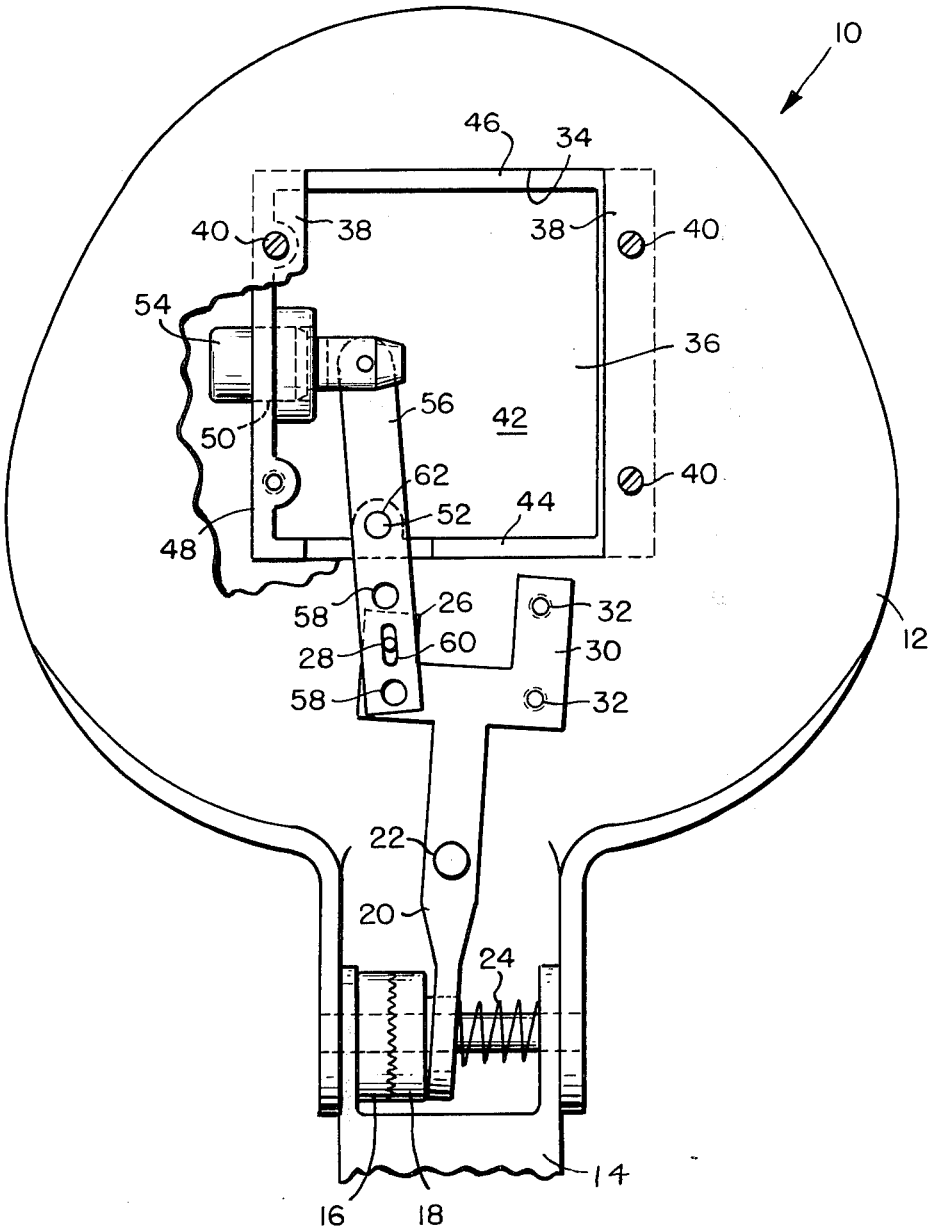
FIG. 1 is a plan view of the headrest assembly with a portion of the cushion material removed to show the mechanism for disengaging the clutch set up for right hand operation.

Referring to the drawings, FIG. 1 shows a headrest generally indicated at 10. It should be appreciated that the upholstery material covering the front of the headrest has been removed so as to expose the internal components. The headrest includes a frame 12 which is journaled at its lower end to a tang, a portion of which is shown at 14. The tang is attached to the backrest of the dental chair (not shown) in a conventional manner and forms no part of the present invention.

The means for locking the headrest in an adjusted position is also conventional. Briefly, the lock means includes a first clutch member 16 which is fixed to the tang, a second clutch member 18 which is axially movable with respect to the first member, a lever arm 20 pivoted to the headrest at 22 for moving the second clutch member out of engagement with the first member and a spring 24 for urging the second clutch member 18 into engagement with the first.

The end of lever 20 on the other side of pivot 22 from clutch member 18 is bifurcate. One branch 26 of this bifurcate end carries a pin 28. The other branch 30 of the bifurcate end has two tapped holes 32, for purposes set out hereinbelow.

Figure 2:
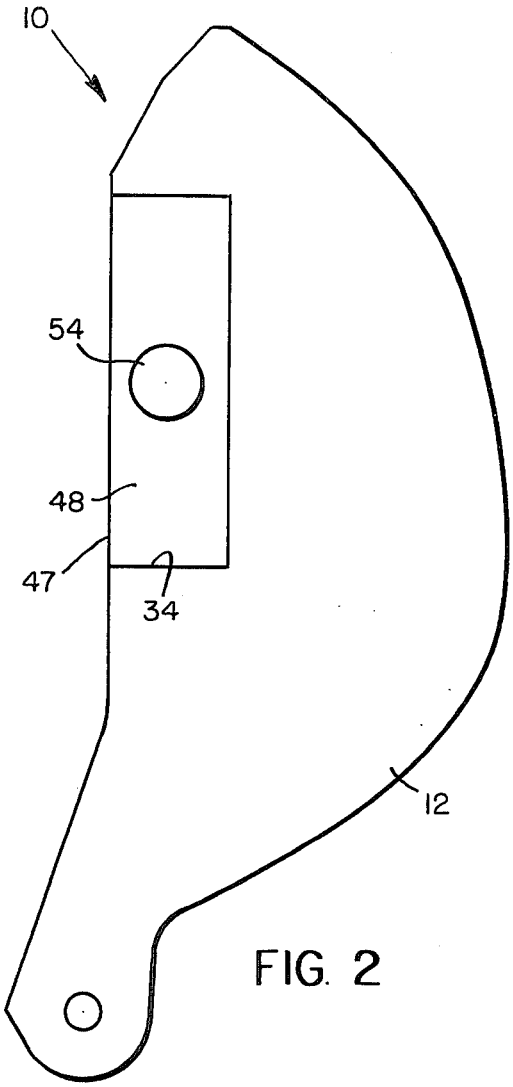
FIG. 2 is a side elevation view of FIG. 1.

The headrest frame 12 has a rectangular opening 34 (FIGS. 1 and 2) for receiving a square housing 36, the housing being attached to flanges 38 within the headrest frame by any suitable means such as screws 40. The square configuration and the location of the screws permit the housing to be attached to the headrest frame either in a first position as shown in FIG. 1 or in a second position wherein the housing is rotated 180° from the first position.

The housing has a base 42. Upstanding from the base according to the orientation as shown in FIG. 1 is a front wall 44 and a rear wall 46 and a side wall 48. Completing the construction of housing 36 is an opening 50 which extends through side wall 48 and a pivot post 52 which is formed integral with the front wall 44 of the housing.

Opening 50 is adapted to receive a push button member 54 which extends into the housing. The portion of the push button within housing 36 is pivotally attached to one end of a link 56. The other end of link 56 is provided with three openings; two openings 58, are clearance holes matching the tap holes 32 on the lever arm second branch 30 and the third opening, 60 is elongated and is elongated and is adapted to receive pin 28. Link 56 has yet another opening 62 intermediate its ends for receiving the pivot post 52.

With respect to the arrangement of the various components as shown in FIG. 1, the operation of the mechanism is as follows. Spring 24, as set out hereinabove, is biased to urge clutch member 16 and 18 into engagement. In order to disengage the clutch, clutch member 18 must be moved to the right as viewed in FIG. 1. This is accomplished in the present invention simply by operating push button 54. Since the operator would normally be standing behind the head of the patient (at the top as viewed in FIG. 1) operation of the button 54 would be accomplished with the right hand of the dentist or his assistant. Accordingly, operating push button 54 moves it to the right as shown in FIG. 1 causing link 56 to rotate clockwise about pivot post 52. Because link 56 is pivotally connected to lever arm 20 by means of pin 28, this movement of the link causes the lever arm to rotate counterclockwise about its pivot 22. Counterclockwise movement of lever 20 in turn carries clutch member 18 away from fixed clutch member 16 so as to unlock the headrest. Thus, with the configuration as shown in FIG. 1, link 56 and lever 20 together form a compound lever system wherein movement of push button 54 at one end of the lever system to the right as shown in FIG. 1 causes clutch member 18 on the other end of the lever system to move in the same direction.

Figure 4:
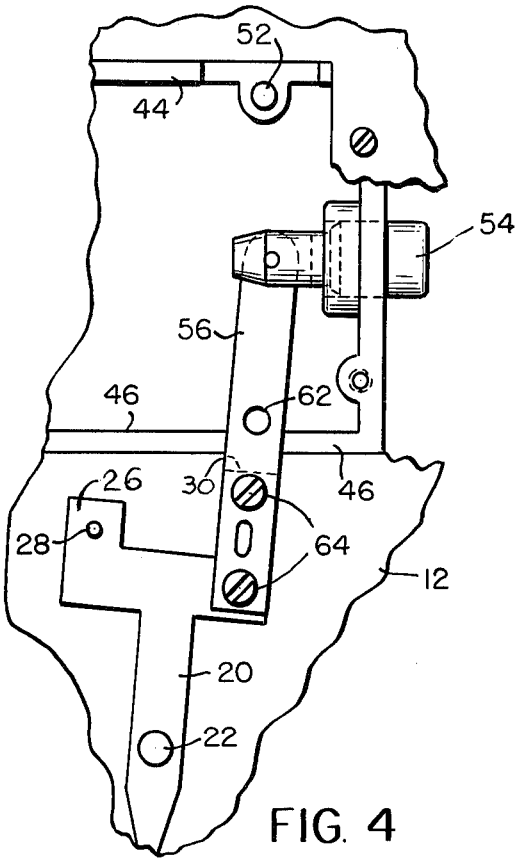
FIG. 4 is a view similar to FIG. 1 only showing a portion of the headrest wherein the mechanism is set up for left hand operation.
Figure 3:
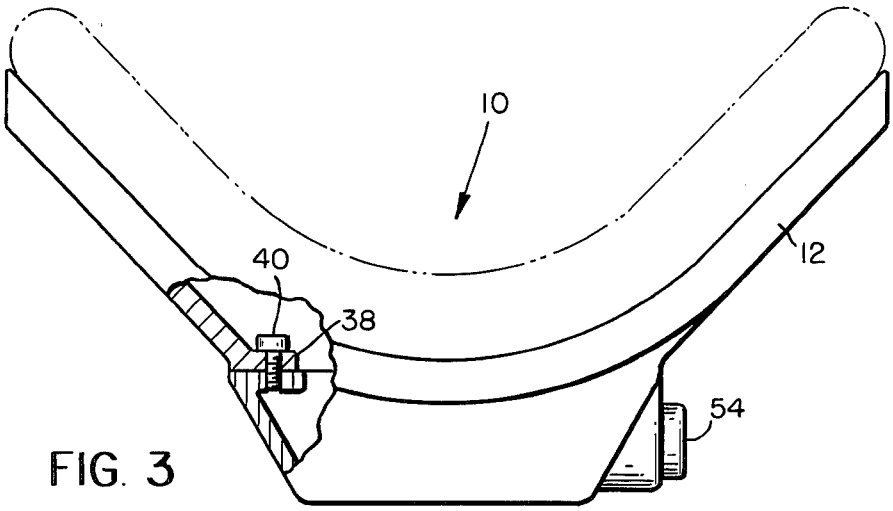
FIG. 3 is an end view of the headrest partly broken away and in section.

In order to permit operation from the left hand side of the headrest, housing 36 is attached to the headrest frame in a second position which is rotated 180° from the first position as shown in FIG. 1. The second position and the configuration of the various components at the second position is illustrated in FIG. 4. As shown in FIG. 4, link 56 is rigidly attached to the second branch 30 of the lever arm. This is accomplished by any suitable means such as with screws 64 that pass through clearance openings 58 and are threaded to tap holes 32 in the second branch. With this arrangement, link 56 merely forms an extension of the second branch 30 so that when push button 54 is operated, link 56 is moved to the left as shown in FIG. 4 which rotates the lever arm counterclockwise about its pivot 22. As set forth hereinabove, counterclockwise rotation of lever arm 20 moves clutch member 18 to the right and away from the fixed clutch member 16 to unlock the headrest. With link 56 merely forming an extension of lever arm branch 30, the link and lever arm together form a simple lever system for disengaging the clutch members wherein movement of push button 54 on one end of the lever system causes clutch member 18 on the other end to move in the opposite direction.

Thus, it should be appreciated that the present invention accomplishes its intended objects by providing a simple, easily assembled mechanism for unlocking an articulated headrest of a dental chair or the like. The invention allows the identical components to be quickly and easily rearranged so as to permit either a left hand or a right hand operation of the mechanism.

I claim:

1. In a headrest for dental chairs and the like including a headrest frame journaled for articulation to the dental chair, clutch members within the headrest frame for locking the headrest in an adjusted articulated position, and a lever arm pivoted within the headrest for disengaging the clutch members, the improvement comprising:

a. said lever arm having a bifurcate end remote from said clutch members;

b. a housing including side and end walls, said housing being attachable to said headrest frame in either a first position or a second position wherein the housing is rotated 180° from the first position;

c. a pivot post adjacent one of said end walls;

d. a push button extending through one of said side walls;

e. a link having one end connected to said push button and a second end;

f. said link, when said housing is in said first position being fixed to a first branch of said bifurcate lever end to form an extension of said one branch, said link and lever together forming a simple level system for disengaging said clutch members when said push button is operated; and g. said link, when said housing is in said second position, being pivoted intermediate its ends to said pivot post, said second link end being pivotally connected to the second branch of said bifurcate lever end, said link and lever so connected together forming a compound lever system for disengaging said clutch members when said push button is operated.

2. A headrest as in claim 1 wherein said headrest frame has a rear surface with an opening therethrough, said housing being fixed in said opening.

3. A headrest as in claim 2 including a flange within said headrest frame adjacent said opening, said housing being attachable to said flange.

4. A headrest as in claim 1 wherein said pivot post is formed integral with said one end wall of said housing.

5. A headrest as in claim 4 wherein said link has an opening intermediate its ends adapted to receive said pivot post.

6. A headrest as in claim 1 wherein said lever arm and link have engagable members to provide a pivoting connection therebetween.

7. A headrest as in claim 1 including a pin on said second branch, said link second end having an elongated opening therethrough to receive said pin for pivotally connecting said second branch and link.

8. A headrest as in claim 1 wherein said first branch is provided with a pair of tapped holes, said link second end having a pair of clearance openings corresponding to said tapped holes for rigidly fixing together said first branch and link with screws.

* * * * *